US006776079B1

(12) United States Patent
Barker et al.

(10) Patent No.: US 6,776,079 B1
(45) Date of Patent: Aug. 17, 2004

(54) ASYMETRICALLY CONTOURED ELASTOMERIC DISK

(75) Inventors: William P. Barker, Bristol, RI (US); Jeffrey R. Milburn, Providence, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/627,142

(22) Filed: Jul. 25, 2003

(51) Int. Cl.[7] ..... F41F 3/04

(52) U.S. Cl. ..... 89/1.809; 114/238; 114/316; 114/317; 114/318; 114/319; 124/70; 417/474; 89/1.81

(58) Field of Search ..... 114/238, 316, 114/317, 319, 318; 124/70; 89/1.809, 1.81; 417/474

(56) References Cited

U.S. PATENT DOCUMENTS

| | | | | | |
|---|---|---|---|---|---|
| 3,962,951 | A | * | 6/1976 | Schenk | 89/1.81 |
| 4,632,035 | A | | 12/1986 | Maillet | 102/420 |
| 4,848,210 | A | | 7/1989 | Bissonnette | 89/1.81 |
| 5,074,187 | A | * | 12/1991 | Vollersen et al. | 89/1.809 |
| 5,099,745 | A | | 3/1992 | Hubbell | 89/1.8 |
| 5,125,318 | A | * | 6/1992 | Purser | 89/1.809 |
| 5,200,572 | A | * | 4/1993 | Bissonnette et al. | 89/1.81 |
| 5,231,241 | A | * | 7/1993 | Bissonnette | 89/1.81 |
| 5,410,978 | A | * | 5/1995 | Waclawik et al. | 114/238 |
| 5,438,948 | A | | 8/1995 | Moody | 114/319 |
| 5,546,839 | A | * | 8/1996 | Gardiner | 83/128 |
| 5,562,065 | A | | 10/1996 | Duarte | 114/238 |
| 5,568,782 | A | | 10/1996 | Moody | 114/238 |
| 5,645,006 | A | | 7/1997 | Moody | 114/238 |
| 5,898,125 | A | | 4/1999 | Mangolds | 102/439 |
| 5,988,036 | A | | 11/1999 | Mangolds | 86/1.1 |
| 6,079,347 | A | | 6/2000 | Lieb | 114/238 |
| 6,216,626 | B1 | | 4/2001 | Curtis | 114/238 |
| 6,220,196 | B1 | | 4/2001 | Escarrat | 114/238 |
| 6,595,098 | B1 | * | 7/2003 | Wray | 89/1.809 |

FOREIGN PATENT DOCUMENTS

| | | | |
|---|---|---|---|
| EP | 0638398 | * | 7/1995 |

* cited by examiner

*Primary Examiner*—Michael J. Carone
*Assistant Examiner*—John Richardson
(74) *Attorney, Agent, or Firm*—James M. Kasischke; Michael P. Stanley; Jean-Paul A. Nasse

(57) ABSTRACT

An elastomeric disk for use in an elastomeric ejection system in which a thickened curvature protrudes from both sides of a central plane of the disk. Integral to each curvature is an annulet which dovetails from the curvatures to a periphery of the disk. The thickness of the annulet in regard to the central plane is greater on the fluid pressure side of the disk thereby shifting material strain to the center of the disk during expanding deformation. The annulet shape is attachable to the elastomeric ejection system by a clamp of the system.

7 Claims, 7 Drawing Sheets

-PRIOR ART-

-PRIOR ART-

-PRIOR ART-

ASYMETRICALLY CONTOURED ELASTOMERIC DISK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a device for use in an elastomeric vehicle launching system, and more particularly to an elastomeric disk for the storage of elastic energy convertible to impulse fluid energy with the impulse fluid capable of ejecting or launching vehicles from the system into a liquid medium.

(2) Description of the Prior Art

Impulse fluid flows are used to launch vehicles from submarine platforms. Elastomeric ejection systems have been developed which store impulse fluid in a charged elastomeric bladder or against the pressure surface of a distended elastomeric disk. In the operation of an ejection system with an elastomeric disk, a recharge pump of the system draws water from the ocean such that the inflow of water has a pressure that distends or expands the disk. The elastic deformation of the disk by expansion results in a storage of energy by the disk. Once a predetermined amount of energy is stored, the recharge pump is shut off.

In order to launch a vehicle, a slide valve for the designated torpedo tube is opened. The opening action of the slide valve allows instantaneous porting water from the expanded disk to the torpedo tube with the porting water pressure capable of launching weapons from the tube.

Typical disks used for elastomeric ejection systems have a flat, ellipsoidal, spherical, or other symmetrically contoured shape. The purpose of a symmetrical contoured shape is to distribute strain energy across the disk during expansion. For example, the prior art disk 2 shown in FIG. 1 and shown in the cross-sectional view of FIG. 2 has a symmetrical contour about a central plane 4. When the prior art disk 2 expands, as shown in FIG. 3, the expansion of the disk 2 outward is the greatest at the center axis 6 of the disk 2. The disk 2 must be clamped or attached at its edges 8, 10 to the supporting structure 12 in order to expand outward.

The problem with the clamping of the disk 2 to the supporting structure 12 is that the expansion of the disk consequently puts a significant material strain at the periphery of the disk 2. While there is a contact strain with the supporting structure 12, the material strain is greater on the pressure surface 14 of the disk 2 specifically at the point 16 where the disk 2 bends toward deformation of the disk. This material strain at the bend of the disk 2 significantly increases the risk of disk failure during operation and interferes with the distribution of material strain across the disk 2. In addition, the variation in the clamping strength of the supporting structure 12 and the loss of material strength of disk 2 at the structure 12 makes it difficult to predict how many cycles of operation the disk 2 can safely withstand.

SUMMARY OF THE INVENTION

Accordingly, it is a general purpose and primary object of the present invention to provide an elastomeric disk resistant to cyclic material failure at its periphery.

It is a further object of the present invention to provide an elastomeric disk in which the peak material strain levels of the disk are located proximate to the center of the disk such that the cycles of operation for the disk can be adequately determined.

It is a still further object of the present invention to provide an elastomeric disk which securely attaches to the structure of an elastomeric ejection system.

To attain the objects described there is provided an elastomeric disk with a thickened curvature protruding from both sides of a central plane of the disk. Integral to each curvature of the disk is an annulet which dovetails from the curvatures to a periphery of the disk. The annulet allows secure attachment of the disk to the ejection system preferably by a clamp of the supporting structure of the ejection system.

In contrast to the prior art, the contour of the disk is asymmetrical at the periphery of the disk. Specifically, the thickness of the annulet in regard to the central plane is greater on the pressure side of the disk. By increasing the thickness of the annulet on the pressure side of the disk, the bending strain and resultant material strain on the disk caused by expansion is compensated for while the holding action of the clamp is maintained. The strengthening of the disk thereby lengthens the material cyclic life of the ejection system since fatigue problems associated with the material strain at the periphery bend are minimized. In addition, the reduction of material strain at the periphery has the result of relocating the higher material strain away from the clamp and towards the center axis of the disk. At the center portion of the disk, incidence of fatigue failure is generally expected and thus a fatigue failure becomes more predictable for maintenance scheduling.

The above and other features of the invention, including various and novel details of construction and combinations of parts will now be more particularly described with reference to the accompanying drawings and pointed out in the claims. It will be understood that the particular devices embodying the invention are shown by way of illustration only and not as the limitations of the invention. The principles and features of this invention may be employed in various and numerous embodiments without departing from the scope of the invention.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
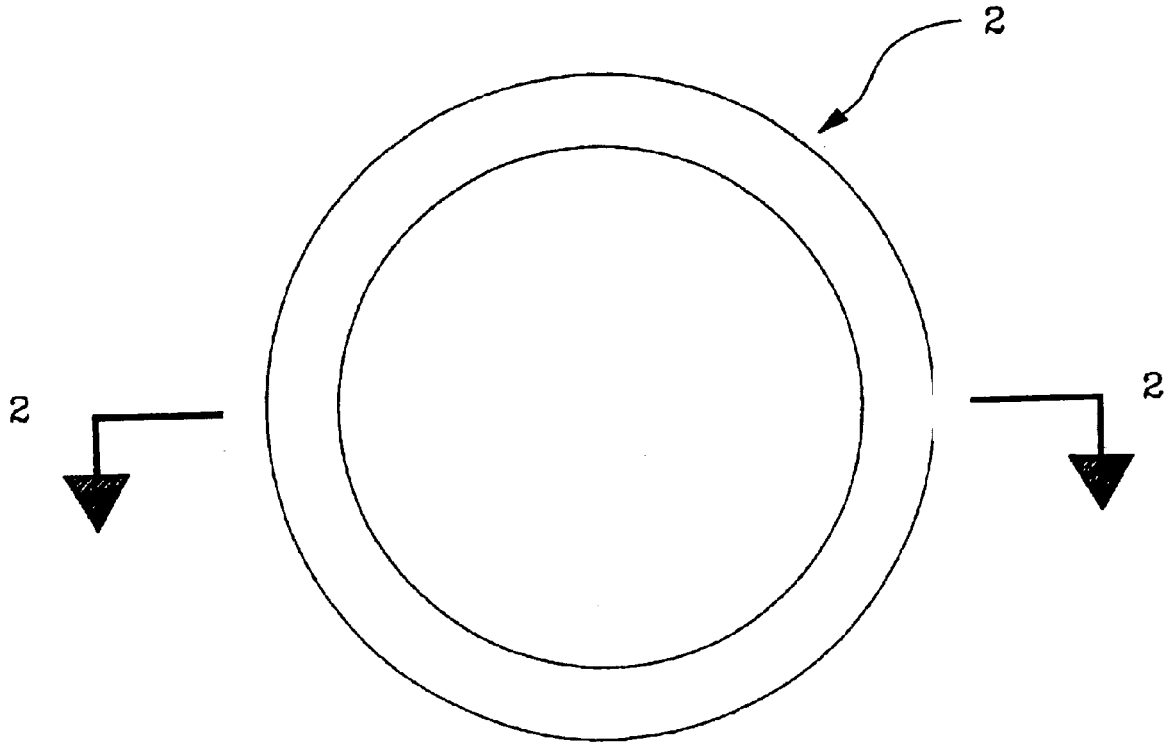
FIG. 1 depicts a plan view of a prior art elastomeric disk.
Figure 2:
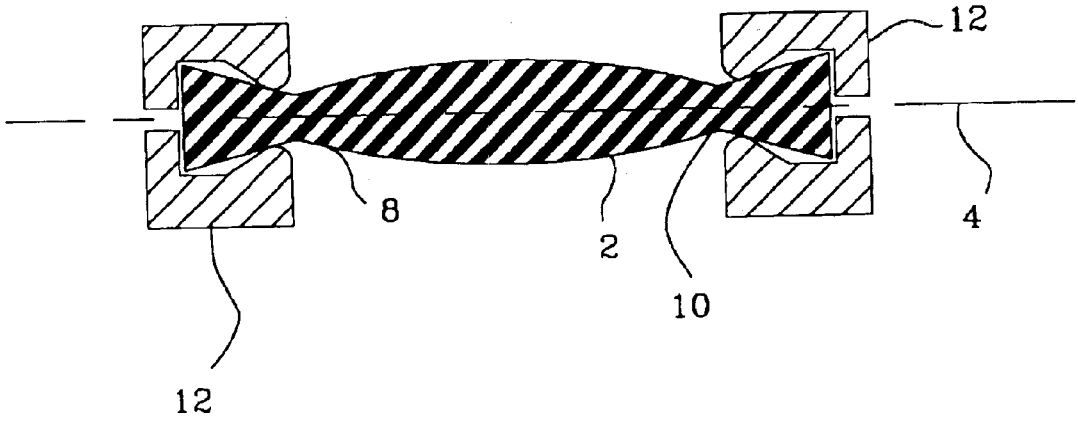
FIG. 2 depicts a cross-sectional view of the prior art elastomeric disk in which the disk is clamped to the support structure of an elastomeric ejection system with the view of the disk taken from reference line 2—2 of FIG. 1.
Figure 3:
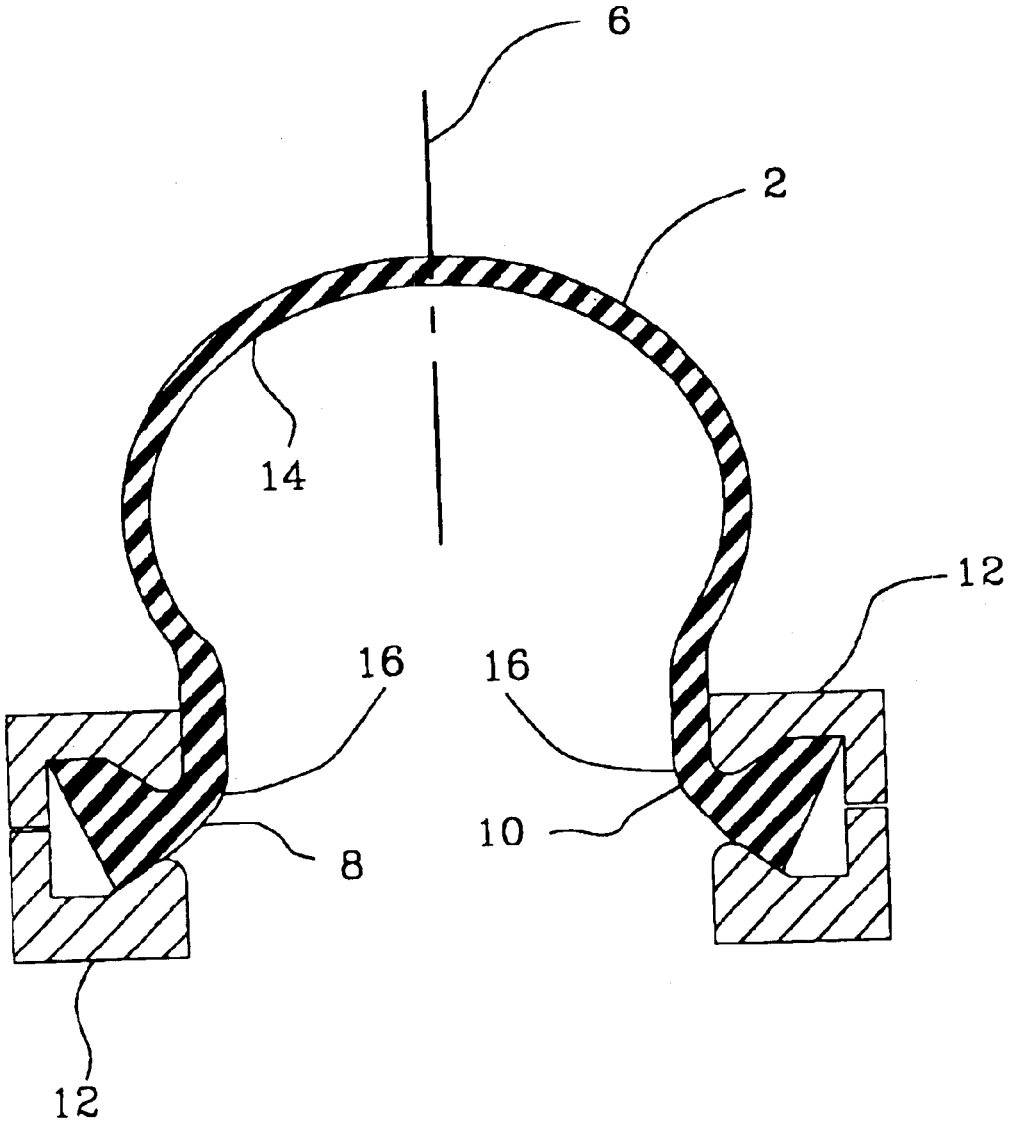
FIG. 3 depicts a cross-sectional view of the prior art disk of FIG. 1 in which the disk is in an expanded state.
Figure 4:
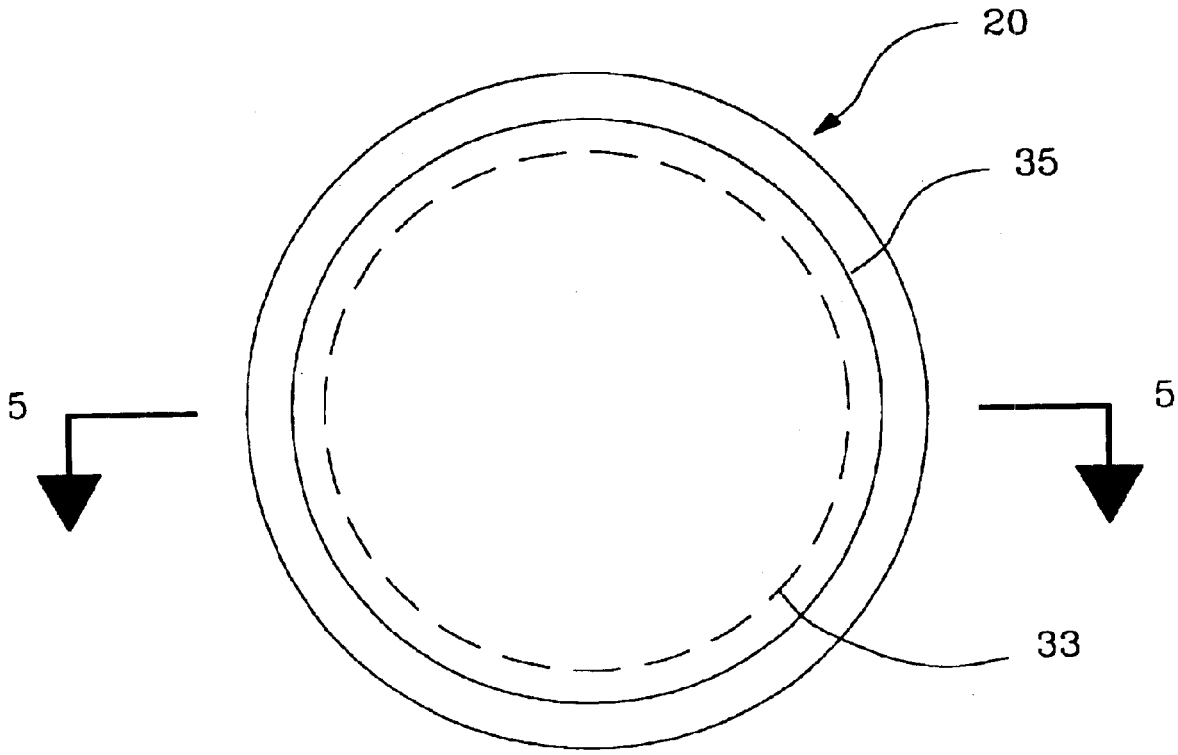
FIG. 4 depicts a plan view of an elastomeric disk of the present invention.
Figure 5:
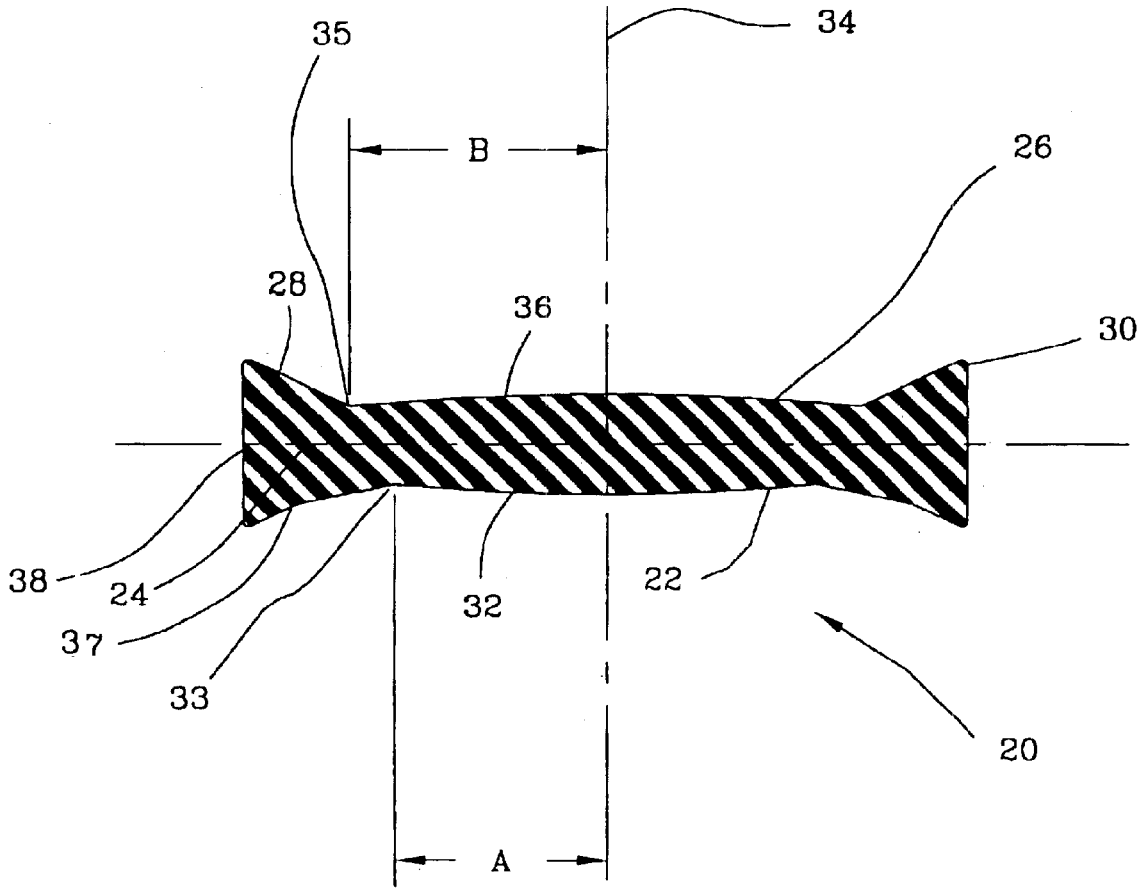
FIG. 5 depicts a cross-sectional view of the disk of the present invention with the view taken from reference line 5—5 of FIG. 4.

Referring now to the drawings including those drawings provided in the prior art portion of this specification wherein like numerals refer to like elements throughout the several is views, one sees that FIG. 4 depicts the elastomeric disk 20 of the present invention. As shown in the cross-sectional view of FIG. 5, the elastomeric disk 20 is formed with a first curvature 22 protruding from a first side of a central plane 24 and a second curvature 26 protruding from a second side of the central plane 24. Integral to the curvatures 22 and 26 is an annulet 28 which dovetails from the taper of the curvatures 22, 26 to a periphery 30 of the disk 20.

As further shown in the figure, the contour of the disk 20 is asymmetrical to the central plane 24 at the annulet 28 of the disk 20. In order to compensate for bending strain associated with attachment to the structure of an ejection system, the thickness of the annulet 28 on the pressure surface 32 is increased. The portion of the annulet 28 on the pressure side 32 originates at a point 33 with the point 33 located a distance "A" from a center axis 34 of the disk 20. The distance "A" is approximately eighty percent of the distance "B" for the point 35 upon which the annulet 28 originates on the non-pressure surface 36 of the disk 20. By originating at the shorter distance of "A", the annulet 28 incorporates a thicker area of the first curvature 22.

In order to reduce the amount of material used while maintaining an increased thickness of the annulet 28, the pressure surface 32 of the annulet 28 indents toward the central plane 24 without indenting the thickness of the annulet 28 between the origination points 33 and 35. The indent 37 is preferably positioned at a majority of the distance to the periphery 30 from the origination point 33. For the remaining distance to the periphery 30, the pressure surface 32 extends away from the central plane 24 to form the widened base 38 of the annulet 28.

Figure 6:
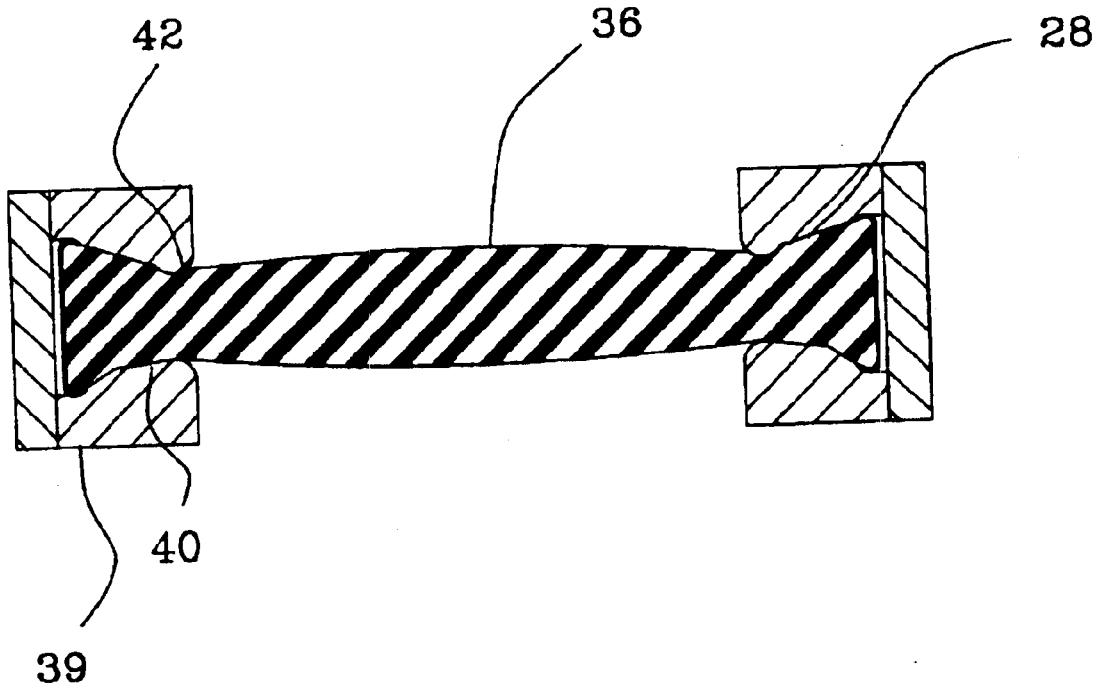
FIG. 6 depicts a cross-sectional view of the disk of the present invention in which the disk is clamped to the support structure of an elastomeric ejection system.
Figure 7:
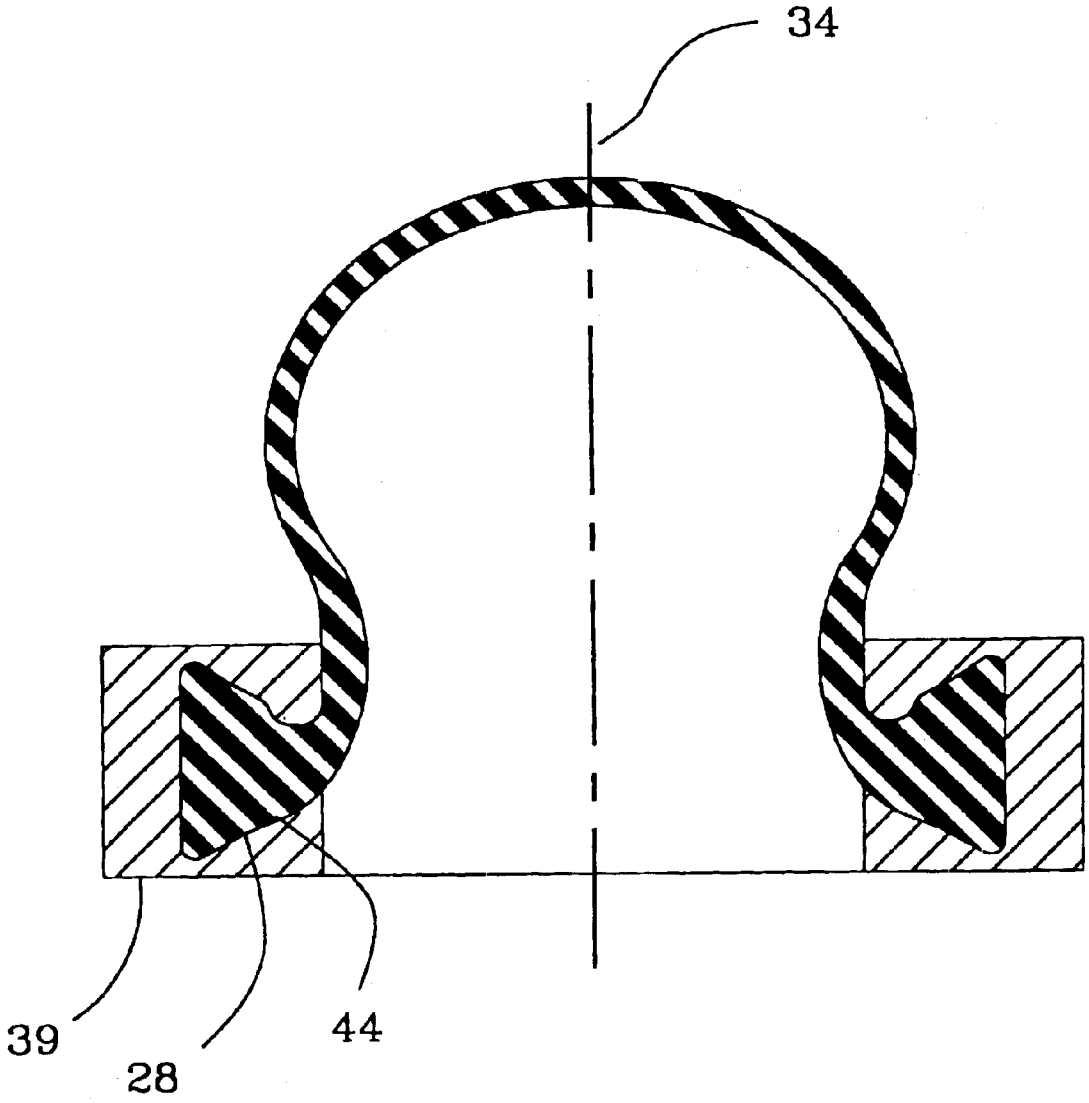
FIG. 7 depicts a cross-sectional view of the disk of the present invention in which the disk is in an expanded state.

As shown in FIG. 6, the dovetailed shape of the annulet 28 still permits clamping by a clamp 39 at the contact area 40 while an arc of clamping by the clamp 39 is maintained on the non-pressure surface 36 at the contact area 42. The result of the increased thickness of the annulet 28 is that the bend area 44 shown in FIG. 7 diverts to the center axis 34 and the annulet 28 is also retained with minimal movement in the clamp 39. As such, a shift of material strain continues to the central axis 34 of the disk 20.

Accordingly, the shift of material strain to the center of the disk 20, also shifts the strain to where a fatigue failure is generally expected and thus a fatigue failure becomes more predictable for maintenance scheduling.

Thus by the present invention its objects and advantages are realized and although preferred embodiments have been disclosed and described in detail herein, its scope should be determined by that of the appended claims.

What is claimed is:

1. An expandable elastomeric disk for retaining and discharging a fluid under pressure, said elastomeric disk comprising:

first and second curvatures protruding opposite to each other from a central plane of said elastomeric disk wherein a surface of said first curvature is contactable to said fluid; and an annulet capable of attachment to a support structure for said elastomeric disk, said annulet including an interior circumference dovetailing to an exterior circumference with said interior circumference integrating to the surface of said first curvature at a first point and integrating to a surface of said second curvature at a second point; and wherein a distance of said first point from a central axis of said elastomeric disk is less than a distance of said second point from said central axis of said said elastomeric disk thereby providing a thickness combining said annulet and said first curvature in relation to said central plane greater than a thickness combining said annulet and said second curvature in relation to said central plane such that said thickness at said annulet and said first curvature reduces material strain at said thickness of said annulet and said first curvature during the expansion of said elastomeric disk with the effect of relocating the material strain to said central axis;

wherein said central axis is perpendicular to said central plane.

2. The elastomeric disk in accordance with claim 1 wherein a surface of said annulet includes an indent originating from said first point toward a thickness of said annulet, said indent providing a reduction in material used for said elastomeric disk.

3. The elastomeric disk in accordance with claim 2 wherein said indent is less than a plane collinear with the protrusion of said first curvature.

4. The elastomeric disk in accordance with claim 3 wherein said indent is positioned at a majority of a distance from said first point to said periphery.

5. The elastomeric disk in accordance with claim 4 wherein said exterior circumference is positioned at a periphery of said elastomeric disk.

6. The elastomeric disk in accordance with claim 5 wherein the distance of said first point from the central axis is at most eighty percent of the distance of said second point from the central axis of said elastomeric disk.

7. The elastomeric disk in accordance with claim 6 wherein said first curvature is contactable to said fluid under pressure as a pressure side of said elastomeric disk and said second curvature protruding opposite to said first curvature as a non-pressure side of said elastomeric disk.

* * * * *